US006110656A

United States Patent [19]

Eichorst et al.

[11] Patent Number: 6,110,656

[45] **Date of Patent: *Aug. 29, 2000**

[54] COLLOIDAL VANADIUM OXIDE HAVING IMPROVED STABILITY

[75] Inventors: Dennis J. Eichorst, Fairport; Sylvia A. Gardner; Gustav R. Apai, II, both of Rochester, all of N.Y.

[73] Assignee: Eastman Kodak Company, Rochester, N.Y.

[ * ] Notice: This patent is subject to a terminal disclaimer.

[21] Appl. No.: 09/161,881

[22] Filed: Sep. 28, 1998

[51] Int. Cl.[7] ..... G03C 1/89

[52] U.S. Cl. ..... 430/527; 430/530; 252/518.1; 252/521.1

[58] Field of Search ..... 430/527, 530; 252/518.1, 521.1

[56] References Cited

U.S. PATENT DOCUMENTS

| | | | |
|---|---|---|---|
| 4,203,769 | 5/1980 | Guestaux | 430/631 |
| 4,582,781 | 4/1986 | Chen et al. | 430/527 |
| 5,006,451 | 4/1991 | Anderson et al. | 430/527 |
| 5,073,360 | 12/1991 | Kairy et al. | 423/608 |
| 5,203,884 | 4/1993 | Buchanan et al. | 51/295 |
| 5,221,598 | 6/1993 | Anderson et al. | 430/527 |
| 5,284,714 | 2/1994 | Anderson et al. | 428/474.5 |
| 5,356,468 | 10/1994 | Havens et al. | 106/195 |
| 5,360,706 | 11/1994 | Anderson et al. | 430/529 |
| 5,366,544 | 11/1994 | Jones et al. | 106/187 |
| 5,366,855 | 11/1994 | Anderson et al. | 430/530 |
| 5,380,584 | 1/1995 | Anderson et al. | 428/323 |
| 5,427,835 | 6/1995 | Morrison et al. | 428/96 |
| 5,432,050 | 7/1995 | James et al. | 430/496 |
| 5,439,785 | 8/1995 | Boston et al. | 430/530 |
| 5,455,153 | 10/1995 | Gardner | 430/530 |
| 5,514,528 | 5/1996 | Chen et al. | 430/530 |
| 5,576,163 | 11/1996 | Anderson et al. | 430/529 |
| 5,607,825 | 3/1997 | Carlson | 430/527 |
| 5,637,368 | 6/1997 | Cadalbert et al. | 428/40.1 |
| 5,659,034 | 8/1997 | DeBord et al. | 546/2 |
| 5,709,984 | 1/1998 | Chen et al. | 430/527 |
| 5,718,995 | 2/1998 | Eichorst et al. | 430/39 |
| 5,726,001 | 3/1998 | Eichorst | 430/527 |
| 6,013,427 | 1/2000 | Eichorst et al. | 430/530 |

OTHER PUBLICATIONS

Mater. Res. Soc. Symp. Proc. vol. 233, pp. 183–194, 1991.
Chem. Mater. vol. 8, pp. 1992–2004, 1996.
Chem. Mater. vol. 3, pp. 992–994, 1991.
Chem. Mater. vol. 8, pp. 525–534, 1996.
Adv. Mater., vol. 5, No. 5, pp. 369–372, 1993.

*Primary Examiner*—Janet Baxter
*Assistant Examiner*—Amanda C. Walke
*Attorney, Agent, or Firm*—Andrew J. Anderson

[57] ABSTRACT

In accordance with one embodiment of the invention, a process for forming an electrically conductive layer is disclosed comprising (i) intercalating colloidal vanadium oxide with a water soluble vinyl-containing polymer, (ii) incorporating the intercalated colloidal vanadium oxide in a coating composition, and (iii) coating the coating composition on a substrate. In accordance with a second embodiment of the invention, a composition for forming an electrically conductive element or layer thereof is disclosed comprising (i) colloidal vanadium oxide intercalated with a water soluble vinyl-containing polymer and (ii) a binder which is distinct from the water soluble vinyl-containing polymer. Intercalation of vanadium oxide gels with water-soluble polymeric species in accordance with of the present invention results in a vanadium oxide gel having improved solution stability and reduced impact of solution aging on conductivity.

23 Claims, No Drawings

COLLOIDAL VANADIUM OXIDE HAVING IMPROVED STABILITY

CROSS REFERENCE TO RELATED APPLICATIONS

Reference is made to concurrently filed, commonly assigned, copending U.S. Ser. No. 09/162,174, entitled "Imaging Element Comprising an Electrically-Conductive Layer Containing Intercalated Vanadium Oxide", and U.S. Ser. No. 09/162,182, entitled "Imaging Element Comprising an Electrically-Conductive Layer Containing Intercalated Vanadium Oxide and a Transparent Magnetic Recording Layer", the disclosures of which are incorporated by reference in their entireties.

FIELD OF THE INVENTION

This invention relates generally to compositions for forming antistatic layers or electrode layers containing colloidal vanadium oxide. More specifically, this invention relates to colloidal vanadium oxide having improved stability in combination with a variety of polymers, solvents and surfactants typically used for coating compositions. The coating compositions are useful for imparting antistatic properties to a variety of articles, including imaging elements, electronic packaging, and fibrous materials.

BACKGROUND OF THE INVENTION

Antistatic or static dissipative layers are of considerable interest for a variety of industries for reducing static charge build-up which can result either in a static discharge (sparking) or in the accumulation of static charge and the attraction of dirt or conveyance problems. Static charge problems are particularly of concern during the manufacture or coating of products in a roll form containing a polymeric web, such as photographic films, adhesive tapes, magnetic recording tapes, packaging films, and transparency films, and during the manufacture of fibrous products such as carpets and brushes. The charge generated during the manufacturing or coating process results primarily from the tendency of webs of high dielectric constant polymeric film base to undergo triboelectric charging during winding and unwinding operations, during conveyance through coating machines, and during finishing operations such as slitting, chopping, cutting, rolling, perforating, and spooling.

Problems associated with the generation and discharge of electrostatic charge during the manufacture and use of photographic film and paper have been recognized for many years by the photographic industry. The accumulation of charge on film or paper surfaces can cause difficulties in support conveyance as well as lead to the attraction of dust, which can produce fog, desensitization, repellency spots during emulsion coating, and other physical defects. The discharge of accumulated static charge during or after the application of the sensitized emulsion layer(s) can produce irregular fog patterns or static marks in the emulsion. The severity of the static problems has been exacerbated greatly by increases in sensitivity of new emulsions, increases in coating machine speeds, and increases in post-coating drying efficiency. Static charge can also be generated during the use of the finished photographic product. In an automatic camera, the repeated winding and unwinding of the photographic film in and out of the film cassette can result in the generation of electrostatic charge, especially in a low relative humidity environment. The accumulation of charge on the film surface results in the attraction and adhesion of dust to the film and can even produce static marking. Similarly, high-speed automated film processing equipment can generate static that produces marking. Sheet films are especially subject to static charging during use in automated high-speed film cassette loaders (e.g., x-ray films, graphic arts films, etc.).

Reduction of electrostatic charge is particularly important during manufacture and handling of electronic components since excess electrostatic charge can damage semiconductor based components. For example, during a masking step, a pressure sensitive adhesive tape may be brought in contact with electronic components. Build-up of a high electrostatic charge during unwinding of the tape can result in static discharge when the tape contacts the electronic component. In addition, electrostatic charge can result in dust attraction which can result in misalignment of masks, inadequate exposure during photoresist exposure or pinhole formation when overcoated with a dielectric layer. Conventionally, electostatic charge is removed by the action of ionized air on the tape. However, this is typically only a temporary solution. Conductive tapes or packaging films are also desired for packaging of electronic components for customer use. For example, computer memory chips are frequently shipped in conductive packaging for upgrading the memory of a personal computer since static discharge during unpacking of the electronic components can severely damage the material.

Static electricity is also a concern during abrading, finishing or sanding operations involving insulating or semi-insulating materials such as wood, plastics, minerals and ceramics. These operations may employ an abrasive layer containing abrasive grains such as aluminum oxide, silicon carbide, diamond, silicon nitride, silicon boride, or tungsten carbide. Static electricity is generated by the constant separation of the abrasive materials from the workpiece, machinery drive rolls, idler rolls, and support pad for the abrasive product. Sudden discharge of this static charge, which can be on the order of 50 to 100 kV, can cause injury to an operator or ignition or explosion of abraded dust particles. The static charge can also cause adhesion of abraded particles, making it difficult to remove by conventional exhaust systems, resulting in excess wear or poor finishing.

Electrostatic charge also builds up easily in transparent substrates used for image displays, for example, in image display parts of TV Braun tubes. The electron beam in a cathode ray tube, which forms the TV Braun tube or the display of a computer monitor, impacts a fluorescent screen which emits red, green and blue light. When the electron beam collides with the fluorescent material a static charge is generated. The static charge can result in attraction of dust to the display screen or possible deflection of the electron beam resulting in poor image quality.

Antistatic agents are also frequently added to rubber to dissipate static charge generated by a tire moving over a surface, to polyurethane used in the sole of shoes or as floor covering to dissipate static charge resulting from repeated contact and separation of surfaces.

An antistatic agent can be incorporated in rubbers, plastics, papers, etc. or dispersed in a solution containing a polymeric binder to give a coating formulation which may be applied on various supports, sheets, webs or articles. Many of the traditional antistatic agents used in the above elements employ materials which exhibit predominantly ionic conductivity. Antistatic layers containing simple inorganic salts, alkali metal salts of surfactants, alkali metal ion-stabilized colloidal metal oxide sols, ionic conductive polymers or polymeric electrolytes containing alkali metal salts and the like have been taught in prior art. The electrical conductivities of such ionic conductors are typically strongly dependent on the temperature and relative humidity of the surrounding environment. At low relative humidities and temperatures, the diffusional mobilities of the charge carrying ions are greatly reduced and the bulk conductivity is substantially decreased. Further, at high relative humidities, an unprotected antistatic backing layer containing such an ionic conducting material can absorb water, swell, and soften. Especially in the case of roll films, this can result in the adhesion and even physical transfer of portions of an antistatic layer to a surface layer on the opposite side of the support. Therefore, it is generally preferred to use electronically-conductive materials. Many of the applications indicated above also generate heat which can alter the ionic conductivity or even result in degradation or reaction of the conductive species.

Antistatic layers containing colloidal vanadium pentoxide described in U.S. Pat. Nos. 4,203,769; 5,203,884; 5,427,835; 5,439,785; 5,637,368 and others are highly effective at providing static protection, have excellent transparency and are not significantly dependent on humidity. Colloidal vanadium pentoxide is composed of highly entangled microscopic fibrils or ribbons 0.005–0.01 $\mu$m wide, about 0.001 $\mu$m thick, and 0.1–1 $\mu$m in length. The high aspect ratio of vanadium pentoxide gel allows excellent conductivity to be achieved at very low vanadium pentoxide coverages. In order to improve the durability of the antistatic layer and adhesion to underlying or overlying layers it is generally preferred to disperse the colloidal vanadium pentoxide gel in a polymeric binder. As disclosed in the above mentioned U.S. patents several polymer binders, for example interpolymers of vinylidene chloride, have been used for aqueous-based coating compositions. However, due to the solution chemistry and oxidative potential of vanadium oxide, the selection of compatible solvents, binders and coating aids is limited. For example, for low coating coverages the vanadium pentoxide may typically be coated at 0.05 wt % or less. At such low concentrations the vanadium pentoxide is prone to instability and flocculation. Depolymerization of the vanadium pentoxide gel into ions may also occur at low concentrations or low pH values. A film-forming sulfopolyester latex or polyesterionomer binder can be combined with colloidal vanadium pentoxide in the coating composition for improved solution stability of the coating formulation and to minimize degradation during processing of the coated layer as taught in U.S. Pat. Nos. 5,360,706; 5,380,584; 5,427,835; 5,576,163; and others. Redox reactions between the vanadium pentoxide and solvents, polymeric binder or coating aids can result in degradation of polymer properties and in alteration of the electrical conductivity of the antistatic material. Reaction between vanadium oxide and various solvents, binders or coating aids is also accelerated by an increase in temperature. Consequently, the utility of vanadium oxide antistatic layers for applications such as thermal imaging elements, various display systems, and abrading, finishing or sanding operations can be severely limited based on reactivity of vanadium oxide and other components of the desired layer when subjected to elevated temperatures.

U.S. Pat. No. 5,718,995 discloses an antistatic layer containing vanadium pentoxide gel and a specified polyurethane binder having excellent adhesion to surface treated support and an overlying magnetic layer. However, it is further disclosed that the coating composition has limited solution stability.

U.S. Pat. No. 5,203,884 describes coated abrasive articles having vanadium oxide present to reduce accumulation of static electrical charge. It is further disclosed that a sulfonated polymer is preferred to aid in securing the vanadium oxide to the abrasive article.

U.S. Pat. No. 5,637,368 describes an adhesive tape having a support, an adhesive layer and a vanadium oxide layer. It is further disclosed that a sulfopolymer is used in conjunction with the vanadium oxide layer. The sulfopolymer may be mixed with vanadium oxide or provided as a layer either over or under the vanadium oxide layer.

In addition to the aqueous-based coating compositions described above it may also be advantageous to coat antistatic layers from a solvent-based formulations. U.S. Pat. No 5,709,984 describes antistatic layers comprised of a dispersion of colloidal vanadium pentoxide gel and an interpolymer of vinylidene chloride prepared from a solvent mixture of ethanol and acetone. U.S. Pat. Nos. 5,356,468 and 5,366,544 describe vanadium pentoxide gels dispersed in cellulosic binders coated from a variety of solvents. In addition to the potential for incompatibility of binders, it is well known that vanadium pentoxide can act as a catalyst or reactant for organic solvents. Potential decomposition products can adversely impact the coating quality of the antistatic layer and potentially adversely impact the sensitometric performance of photographic emulsions.

Intercalation of various species, including cations, metal-containing complexes, organic molecules and polymers, within vanadium oxide is well-known, particularly in the catalysis field and as cathode materials for batteries. However, intercalated colloidal vanadium oxide for antistatic applications has not typically been addressed.

U.S. Pat. No. 5,659,034 describes intercalation of metal coordination complexes, particularly $Zn(2,2'\text{-dipyridyl})_2$, between layers of vanadium oxide. The resultant intercalated vanadium oxide was described as black rod-shaped crystals which are unsuitable for antistatic applications for transparent elements such as photographic imaging elements, typical electronic packaging films, or display elements.

U.S. Pat. No. 5,073,360 describes the formation of bridged/lamellar metallic oxides having intercalated spheroidal cationic species. The preferred metallic oxide is vanadium pentoxide and the spheroidal cationic species is preferably an aluminum polyoxocation, particularly $[Al_{13}O_4(OH)_{24}]_7^+$. The vanadium oxide gel can be prepared for example by ion exchange or melt quenching. The intercalated material is then isolated by filtration, dried and optionally calcined to give high surface area materials which are particularly suited as molecular sieve filters, catalysts, and catalyst supports. However, no indication is given regarding the antistatic properties of the intercalated vanadium oxide.

Intercalation of a wide variety of organic or polymeric materials between vanadium oxide layers in vanadium oxide gels is well known. Intercalative polymerization of aniline resulting in polyaniline is described in Mater. Res. Soc. Symp. Proc. V. 233, pp. 183–194, 1991 and Chem. Mater. V. 8, pp. 1992–2004, 1996. A significant decrease in oxygen concentration and a color change from red to dark blue was observed when vanadium oxide gel was added to an air saturated solution of aniline in water. Conductivity of the polyaniline-vanadium oxide material increased substantially upon aging. It was proposed that conductivity in the fresh material occurred by electron transport through the vanadium oxide framework (semiconductive) but upon aging a metallic-like conductivity dominated as polyaniline chains formed.

Poly(ethylene oxide) intercalated vanadium oxide gels were reported in Chem. Mater, Vol. 3, 992–994, 1991 and Chem. Mater, Vol. 8, 525–534, 1996 to be highly light sensitive, turning dark blue within several weeks due to exposure to room light or within several hours due to exposure to UV irradiation. Non-intercalated vanadium oxide gels were not light sensitive. In addition to a color change, the conductivity increased and solubility decreased with increasing irradiation. However, the irradiated conductivity decreased with increasing polyethylene oxide intercalation. Changes in the vanadium oxide interlayer distance due to intercalation of poly(vinylpyrrolidone) (PVP), poly (propylene-glycol) (PPG), and methylcellulose are described in Adv. Mater, Vol. 5, 369–372, 1993. Interlayer distance increased linearly for $(PVP)_xV_2O_5 \cdot nH_2O$ for values of x up to 3. Furthermore, a change in the chemical nature of PVP was noted and ascribed to formation of hydrogen bonding with co-intercalated water. The interlayer spacing did not vary linearly with either PPG or methylcellulose. The interlayer distance remained constant for $(PPG)_xV_2O_5 \cdot nH_2O$ with x values greater than 1, and PPG remained chemically unaltered. Particularly in the case of PPG, the samples were light sensitive as indicated above.

The above references indicate a vast array of organic or polymeric species can be intercalated within vanadium oxide gel structures. However, the intercalated material is frequently light sensitive and conductivity changes during aging. Furthermore, intercalation and subsequent reaction frequently decreases solubility of the vanadium oxide gel.

The use of polyvinylpyrrolidone in antistatic formulations is also well known. For example, U.S. Pat. Nos. 4,418,141; 4,495,276; 5,368,995; 5,484,694; 5,453,350; 5,514,528 and others include polyvinylpyrrolidone amongst an extensive list of suitable binders for antistatic materials such as tin oxide or zinc antimonate. There is no specific mention or claim to enhanced properties or stability of polyvinylpyrrolidone or other water soluble vinyl-containing polymers relative to other polymeric binders for the above mentioned patents.

U.S. Pat. No. 4,489,152 describes a diffusion transfer film having an opaque layer consisting of carbon black having 2–10 percent polyvinylpyrrolidone based on the weight of carbon black. The addition of polyvinylpyrrolidone having a molecular weight of about 10,000 to the carbon black layer was found to improve the silver transfer process. However, there was no indication of antistatic properties nor of formulation stability for the carbon black layer.

U.S. Pat. No. 4,860,754 describes an electrically conductive adhesive material consisting of a low molecular weight plasticizer, a high molecular weight water soluble, crosslinkable polymer, uncrosslinked polyvinylpyrrolidone, and an electrolyte. The uncrosslinked polyvinylpyrrolidone is added as a tackifier.

U.S. Pat. No. 5,637,368 describes the use of colloidal dispersions of vanadium oxide for imparting antistatic properties to adhesive tapes. Polyvinylpyrrolidone and polyvinylpyrrolidone copolymers are included in a list of suitable adhesive compounds. The use of vanadium oxide in the adhesive layer is suggested, but all examples consist of a separate vanadium oxide layer and a separate adhesive layer. In addition polyvinylpyrrolidone was not demonstrated nor disclosed to give superior performance.

As disclosed in the above mentioned U.S. patents several polymers, for example interpolymers of vinylidene chloride, sulfopolyesters, polyesterionomers, and cellulosics have been used as binders for antistatic layers containing colloidal vanadium oxide. However, due to the solution chemistry and oxidative potential of vanadium oxide, the selection of compatible binders and formulation range is limited. For example, for low coating coverages the vanadium pentoxide may typically be coated at 0.05 weight percent or less. Such low concentrations result in coating formulations which are prone to instability and flocculation of the vanadium oxide gel. This creates serious difficulties in accumulation of flocculated vanadium oxide plugging solution delivery lines, filters and coating hoppers. Furthermore, flocculation can result in coating defects or "slugs" which can result in optical and electrical non-uniformities in the coating. The addition of surfactants to the coating solution may stabilize the vanadium oxide gel, however, the typically high levels of surfactant required are undesirable for adhesion and coatability of subsequently applied layers. The concern of stability has been addressed in many of the above patents. Furthermore, interaction between colloidal vanadium oxide and polymeric binders can result in limited dispersion shelf-life. In addition to the potential for incompatibility of binders, it is well known that vanadium pentoxide can act as a reactant or catalyst for decomposition of organic solvents. Decomposition products can adversely impact the coating quality of the antistatic layer and potentially adversely impact the sensitometric performance of photographic emulsions thereby requiring careful selection of coating solvents and binders for the antistatic layer. Furthermore, due to the potential interaction of vanadium pentoxide with solvents and binders, careful consideration must be given to formulation of overlying layers, such as barrier layers and abrasion resistant layers.

Because the requirements for an electrically-conductive layer to be useful for antistatic or electrode applications in a variety of elements or articles are extremely demanding, the art has long sought to develop improved conductive layers exhibiting a balance of the necessary chemical, physical, optical, and electrical properties. As indicated hereinabove, the prior art for providing electrically-conductive layers useful for a variety of elements is extensive and a wide variety of suitable conductive materials have been disclosed. However, there is still a critical need in the art for improved conductive layers which can be used in a wide variety of elements, which can be manufactured at a reasonable cost, which are resistant to the effects of humidity change, which are durable and abrasion-resistant, which exhibit acceptable adhesion to overlying or underlying layers, and which exhibit suitable cohesion.

It is also highly desirable to provide coating formulations which have improved solution stability, improved binder compatibility and reduced catalytic or chemical activity particularly when exposed to elevated temperatures without adversely impacting the transparency and electrical-conductivity of prior art vanadium pentoxide gel antistatic layers. The present invention is directed at providing improved coating formulations that more effectively meet the diverse needs of antistatic layers, especially those for use in silver halide-based photographic elements, thermal imaging elements, display elements, electronic packing and finishing operations but also of a wide variety of other types of elements.

SUMMARY OF THE INVENTION

In accordance with one embodiment of the invention, a process for forming an electrically conductive layer is disclosed comprising (i) intercalating colloidal vanadium oxide with a water soluble vinyl-containing polymer, (ii) incorporating the intercalated colloidal vanadium oxide in a coating composition, and (iii) coating the coating composition on a substrate. In accordance with a second embodiment of the invention, a composition for forming an electrically conductive element or layer thereof is disclosed comprising (i) colloidal vanadium oxide intercalated with a water soluble vinyl-containing polymer and (ii) a binder which is distinct from the water soluble vinyl-containing polymer. It was neither anticipated nor expected that intercalation of vanadium oxide gels with water-soluble polymeric species in accordance with the present invention would result in a vanadium oxide gel having improved solution stability and reduced impact of solution aging on conductivity.

DETAILED DESCRIPTION OF THE INVENTION

This invention provides an intercalated colloidal vanadium oxide for use in conductive layers suitable for antistatic applications or as conductive electrodes having improved chemical, solution and thermal stability relative to prior art colloidal vanadium oxide. The intercalated vanadium oxide consists of colloidal vanadium oxide intercalated with a water-soluble vinyl-containing polymer. Conductive layers containing colloidal vanadium oxide of the present invention are useful for static protection of various recording or imaging elements, for electronic packaging materials, shielding from electromagnetic radiation of electronic components, for display devices including cathode ray tubes, electroluminescent displays, electrochromic displays, and liquid crystal displays, for static dissipation during abrading, finishing and sanding operations and to impart static protection to insulating plastics or rubbers and fibrous materials. Included in the scope of this invention are imaging or recording elements which may contain a conductive layer containing intercalated vanadium oxide include, for example, photographic, electrostatographic, photothermographic, migration, electrothermographic, dielectric recording, and thermal-dye-transfer imaging elements, optical recording and magnetic recording elements. Details with respect to the composition and function of this wide variety of imaging elements are provided in U.S. Pat. No. 5,719,016. Conductive layers containing intercalated colloidal vanadium oxide are also useful for providing static protection in display devices, particularly liquid crystal and electroluminescent displays. Elements that can be provided with antistatic layers in accordance with this invention may differ widely in structure and composition.

Colloidal vanadium oxide is commonly referred to as an "amorphous" gel which is composed of entangled microscopic fibrils, fibers or ribbons 0.005–0.01 $\mu$m wide, about 0.001 $\mu$m thick, and 0.1–1 $\mu$m in length. Colloidal vanadium pentoxide can be prepared by any variety of methods, including, but not specifically limited to melt quenching as described in U.S. Pat. No. 4,203,769, ion exchange as described in DE 4,125,758, hydrolysis of a vanadium oxoalkoxide as claimed in U.S. Pat. No. 5,407,603, hydrolysis or thermohydrolysis of $VOCl_3$ or $VO_2OAc$, reaction of vanadium or vanadium oxide with hydrogen peroxide or nitric acid, and direct hydrolysis of amorphous or fine-grained vanadium oxide. Melt-quenched vanadium oxide can be prepared by melting vanadium pentoxide or a mixture of vanadium oxide and optional additives, dopants or modifiers generally 100° C. to 500° C. above the melting point and quenching the molten mixture into water. The quenched material is typically aged to form a colloidal gel. Other methods of preparing quenched vanadium oxide include laser melting and splat cooling, for example, Rivoalen describes supercooling a melt on a roll cooled to the temperature of liquid nitrogen in J. Non-Crystalline Solids, 21, 171 (1976). Colloidal vanadium gels can be prepared by hydrolysis with a molar excess of deionized water of vanadium oxoalkoxides, preferably a trialkoxide of the formula $VO(OR)_3$ wherein each R is independently an aliphatic, aryl, heterocyclic or arylalkyl group. Preferably, hydrolysis occurs in the presence of a hydroperoxide such as hydrogen peroxide or t-butyl hydrogen peroxide. Ion exchange of soluble vanadium containing species, such as sodium metavanadate or ammonium metavanadate can be used to prepare colloidal vanadium pentoxide gels. In this process, protons are exchanged for the sodium or ammonium ions resulting in a hydrated gel. Preferred methods of preparing colloidal vanadium pentoxide are the melt-quench technique, detailed in U.S. Pat. No. 4,203,769, and hydrolysis of vanadium alkoxide or oxoalkoxides as taught in U.S. Pat. No. 5,407,603, both incorporated herein by reference with respect to the preparation of such dispersions.

Conductivity of vanadium oxide coatings may be enhanced by controlling the colloidal vanadium oxide morphology and vanadium oxidation state. One method of controlling the morphology and oxidation state is by addition of a dopant or modifier. Another method of controlling the vanadium oxidation state is the use of both $V^{4+}$ and $V^{5+}$ containing species, for example during the hydrolysis of vanadium oxoalkoxides. In addition to modifying conductivity or morphology, the presence of a metal dopant or modifier can alter the color or dispersability of colloidal vanadium pentoxide. Dopants or modifiers may include vanadium (4+), lithium, sodium, potassium, magnesium, calcium, manganese, copper, zinc, germanium, niobium, molybdenum, silver, tin, antimony, tungsten, bismuth, neodymium, europium, gadolinium, and ytterbium. Preferred metal dopants are calcium, magnesium, molybdenum, tungsten, zinc and silver. The dopant or modifiers may be added in any form suitable for the selected synthetic method. For example, metal oxides, metal phosphates, or metal polyphosphates may be mixed with vanadium pentoxide and melt quenched; metal alkoxides or metal oxoalkoxides may be added to a solution of vanadium oxoalkoxide and hydrolyzed, or a mixture of metal salts with ammonium vanadate or sodium metavanadate may be used for an ion exchange processes. Typically, when present, dopants or modifiers are added at the 0.1–20 mole percent level. An additional method of increasing the conductivity and adhesion of colloidal vanadium oxide coatings is the addition of a conductivity-increasing amount of a volatile aromatic compound comprising an aromatic ring substituted with at least one hydroxy group or a hydroxy substituted substituent group as disclosed in U.S. Pat. No. 5,709,984 and incorporated herein by reference with regards to volatile aromatic compounds.

Water-soluble vinyl-containing polymers suitable for intercalation of the vanadium oxide gel include: poly-N-vinylpyrrolidone, polyvinylpyrrolidone interpolymers such as polyvinylpyrrolidone-polyvinylacetate, polyvinyl alcohol, polyvinyl alcohol interpolymers such as polyvinyl alcohol-ethylene, polyvinyl methyl ether and the like. Molecular weight of the vinyl-containing polymers may preferably range from about 10,000 to 400,000. Intercalation may be achieved by simply adding a dispersion of a vanadium oxide gel to an aqueous solution of the water soluble polymer. The amount of water soluble vinyl-containing polymer added is such an amount that causes intercalation, but less than that resulting in loss of the fibrous nature of colloidal vanadium oxide. Intercalation is demonstrated by insertion of the polymer between the layers of the colloidal vanadium oxide gel resulting in an increase in basal spacing of the layer by at least 1 Å. Suitable amounts of intercalated polymer can vary depending on the specific water soluble vinyl-containing polymer, the presence of dopant or modifier species, the concentration of colloidal vanadium oxide and the desired conductivity level. However, it is generally preferred to use a molar ratio (based upon monomer units) of intercalating polymer to colloidal vanadium oxide of from 1:4 to 20:1. More preferably, molar ratios of at least 1:2, and most preferably at least 1:1 are used for optimal intercalation. A more preferred upper limit ratio of intercalating polymer to colloidal vanadium oxide is about 5:1, as above such ratio additional polymer may not effectively intercalate. In accordance with specific preferred embodiments of the invention, weight ratios of intercalating polyvinylpyrrolidone polymer to colloidal vanadium oxide of from about 1:2 to 4:1 are used.

In accordance with preferred embodiments of the invention, the use of vanadium oxide gels intercalated with water soluble vinyl-containing polymers allows for the selection of diverse, distinct film-forming binders in electrically-conductive layer coating compositions, including binders which may not effectively be used with non-intercalated vanadium oxides.

Polymeric film-forming binders useful in coating compostions for conductive layers of the present invention include: water-soluble, hydrophilic polymers such as gelatin, gelatin derivatives, maleic acid anhydride copolymers; cellulose derivatives such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamide, their derivatives and partially hydrolyzed products, vinyl polymers and copolymers such as polyvinyl acetate and polyacrylate acid ester; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of polyurethanes, aqueous dispersions of sulfonated polyurethanes, polyesterionomers, and aqueous dispersions of sulfonated polyesters. Additional suitable binders are disclosed in U.S. Pat. Nos. 5,356,468 and 5,366,544, incorporated herein by reference. Gelatin derivatives, aqueous dispersed polyurethanes, sulfonated polyurethanes, polyesterionomers, and aqueous emulsions of vinylidene halide interpolymers, vinyl acetate copolymers, methacrylates and cellulosics are preferred binders for conductive layers of this invention.

Solvents useful for preparing dispersions and coatings useful for the present invention include: water; alcohols such as methanol, ethanol, propanol, isopropanol; ketones such as acetone, methylethyl ketone, and methylisobutyl ketone; esters such as methyl acetate, and ethyl acetate; glycol ethers such as methyl cellusolve, ethyl cellusolve; ethylene glycol, and mixtures thereof. Preferred solvents include water, alcohols, and acetone.

Coating composition in accordance with the invention may desirably comprise vanadium oxide at concentrations of less than 0.15, less than 0.1, and even less than 0.05 weight percent in order to provide thin electrically conductive layers, while generally higher vanadium oxide and water soluble polymer solution concentrations are desired for effectively forming intercalated vanadium oxide. In accordance with specific preferred embodiments of the invention, the colloidal vanadium oxide is accordingly intercalated with the water soluble vinyl-containing polymer by adding a vanadium oxide gel solution to an aqueous solution of the polymer at a weight concentration of vanadium oxide of at least 0.15 in the combined solution, more preferably at least 0.2 weight percent, and resulting intercalated vanadium oxide is then diluted to a weight concentration of vanadium oxide in the coating composition to less than 0.15 weight percent.

In addition to binders and solvents, other components that are well known in the art also can be included in the conductive layer of this invention. Other addenda, such as matting agents, surfactants or coating aids, polymer lattices to improve dimensional stability, fillers, extenders, reinforcing agents, thickeners or viscosity modifiers, hardeners or cross linking agents, soluble antistatic agents, soluble and/or solid particle dyes, opacifiers, antifoggants, lubricating agents, and various other conventional additives optionally can be present.

The ratio of conductive vanadium oxide to polymeric film-forming binder in a conductive layer is one of the critical factors which influences the ultimate conductivity of that layer. If this ratio is too small, little or no antistatic property is exhibited. If the ratio is very large, adhesion between the conductive layer and the support or overlying layers can be diminished. The optimum ratio of conductive material to binder can vary depending on the colloidal vanadium oxide conductivity, vanadium oxide morphology, binder type, total dry weight coverage or coating thickness, and the conductivity requirements for the imaging element. The dry weight ratio of colloidal vanadium pentoxide to polymeric film-forming binder is preferably from 4:1 to 1:500, and more preferably from 2:1 to 1:250.

Colloidal dispersions of intercalated vanadium oxide in suitable liquid vehicles can be formulated with a polymeric film-forming binder and various addenda and applied to a variety of supports, webs, or articles to form electrically-conductive layers. Typical photographic film supports include: cellulose nitrate, cellulose acetate, cellulose acetate butyrate, cellulose acetate propionate, poly(vinyl acetal), poly(carbonate), poly(styrene), poly(ethylene terephthalate), poly(ethylene naphthalate), poly(ethylene terephthalate) or poly(ethylene naphthalate) having included therein a portion of isophthalic acid, 1,4-cyclohexane dicarboxylic acid or 4,4-biphenyl dicarboxylic acid used in the preparation of the film support; polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers, polycarbonates, and the like; blends or laminates of the above polymers. Supports can be either transparent or opaque depending upon the application. Transparent film supports can be either colorless or colored by the addition of a dye or pigment. Other suitable opaque or reflective supports are paper, polymer-coated paper, including polyethylene-, polypropylene-, and ethylene-butylene copolymer-coated or laminated paper, synthetic papers, pigment-containing polyesters, and the like. Of these supports, films of cellulose triacetate, poly(ethylene terephthalate), and poly(ethylene naphthalate) prepared from 2,6-naphthalene dicarboxylic acids or derivatives thereof are preferred. The thickness of the support is not particularly critical. Support thicknesses of 2 to 10 mils (50 $\mu$m to 254 $\mu$m), e.g., are suitable for photographic elements.

Other suitable supports, webs or articles include polyesters, copolyesters, polyamide, polyimide, polyepoxides, polycarbonate, polyolefins such as polyvinyl chloride, polyvinylidene chloride, polystyrene, or polypropylene or polyethylene, polyacrylates such as polymethylmethacrylate, cellulosics, plastics, rubbers, woods, ceramics, such as alumina, silica and zirconia or siliceous materials, glass and glass-ceramics. Fibrous materials containing, for example, polyolefin, nylon, and/or wool would also benefit from antistatic coatings. Suitable plastics in which intercalated vanadium oxide may be incorporated or applied as an antistatic layer include commonly referred to general-purpose plastics and engineering plastics. Examples of general-purpose plastics are polyethylene, vinyl chloride resin, polystyrene, polypropylene, methacrylic resins, urea-melamine resin, phenolic resin, unsaturated polyester resin, rigid vinyl chloride resin, ABS resin and AS resin. Examples of engineering plastics or super-engineering plastics include epoxy resin, polyacetal, polycarbonate, polybutylene terephthalate, polyethylene terephthalate, polyphenylene ether, polyphenylene sulfide, polysulfone, fluorocarbon resin, diallyl phthalate resin, silicone resin, polyimide resin, polyamideimide, bismaleimidetriazine, polyaminobismaleimide, olefin-vinyl alcohol copolymers, polyoxybenzylene, polymethylpentane, polyether sulfone, polyether imide, polyarylate and polyether ketone. Suitable rubbers include silicone rubber, isoprene rubber, styrene-butadiene rubber, butadiene rubber, butyl rubber, butadiene-acrylonitrile rubber, ethylene-propylene-diethane terpolymer, ethylene-propylene rubber, fluororubber, ethylene-vinyl acetate copolymer, chlorinated polyethylene, acrylic rubber, chloroprene rubber, urethane rubber, polysulfide rubber, chloro-sulfonated polyethlyene rubber and epichlorohydrine rubber.

Supports can be surface-treated by various processes including corona discharge, glow discharge, UV exposure, flame treatment, electron-beam treatment, or treatment with adhesion-promoting agents including dichloro- and trichloroacetic acid, phenol derivatives such as resorcinol and p-chloro-m-cresol, solvent washing or overcoated with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like.

Dispersions containing intercalated vanadium oxide, a polymeric film-forming binder, and various additives in a suitable liquid vehicle can be applied to the aforementioned supports, webs, or articles using any of a variety of well-known coating methods. Handcoating techniques include using a coating rod, knife, doctor blade, or brush. Machine coating methods include air doctor coating, reverse roll coating, gravure coating, curtain coating, bead coating, slide hopper coating, extrusion coating, dip coating, spray coating, spin coating, screen printing and the like, as well as other coating methods known in the art.

The electrically-conductive layer can be applied to the support at any suitable coverage depending on the specific requirements of a particular element. For example, for silver halide photographic films, total dry weight coverages for conductive layers containing vanadium pentoxide are preferably in the range of from about 0.002 to 1.5 g/m$^2$ with the higher coverages generally preferred at higher binder/vanadium oxide ratios. More preferred dry coverages are in the range of about 0.005 to 0.5 g/m$^2$. For elements in which optical transparency is not a primary concern, such as in magnetic recording tapes or disks and coated abrasive articles such as sanding belts or disks, dry weight coverages are preferably in the range of from about 0.002 to 5 g/m$^2$. The conductive layers obtained in accordance with the invention typically exhibit a surface electrical resistivity (SER) value of less than $1\times10^{10}$ ohms/square, preferably less than $1\times10^{9}$ ohms/square, and more preferably less than $1\times10^{8}$ ohms/square.

Elements incorporating conductive layers obtained from coating compositions of this invention also can comprise additional layers including adhesion-promoting layers, lubricant or transport-controlling layers, hydrophobic barrier layers, image-forming layers, image-receiving layers, antihalation layers, abrasion and scratch protection layers, antireflective layers, electrode layers, fluorescent layers, abrasive layers, magnetic layers, gas permeability control layers, and other special function layers. Elements incorporating conductive layers in accordance with this invention useful for specific applications such as photographic imaging elements, thermal imaging elements, magnetic recording elements, electronic packaging materials, conductive tapes, coated abrasive articles, and other applications should be readily apparent to those skilled in the arts.

The method of the present invention is illustrated by the following detailed examples of its practice. However, the scope of this invention is by no means restricted to these illustrative examples.

Samples A–D

Colloidal vanadium oxide gels were prepared by a melt-quench method as described in U.S. Pat. No. 4,203,769. Vanadium pentoxide was melted in a furnace, quenched into distilled water and aged for 3 months to form a uniform reddish-brown colloidal gel. The resulting vanadium oxide gel was diluted with distilled water to 0.285 weight percent $V_2O_5$ for Sample A. The vanadium oxide gel was added to solutions in water of polyvinylpyrrolidone (PVP) having an average molecular weight of 37,900 to give the corresponding total weight percentages of $V_2O_5$ and PVP indicated in Table 1 for Samples B-D.

Samples E–H

Colloidal vanadium oxide gels were prepared by a melt-quench method as described in U.S. Pat. No. 4,203,769. Mixtures of silver oxide (up to 10 mole percent) and vanadium pentoxide were melted in a furnace, quenched into distilled water and aged for 3 months to form a uniform reddish-brown colloidal gel. The resulting silver-doped vanadium oxide gels were diluted with distilled water to 0.285 weight percent $V_2O_5$ for Sample E or added to solutions of PVP in water to give the corresponding total weight percentages of $V_2O_5$ and PVP indicated in Table 1 for Samples F-H.

Samples I and J

Colloidal vanadium oxide gels were prepared by an ion exchange method. 300 ml of a 0.35 M solution of sodium metavanadate in distilled water was poured through a column of 100 grams Dowex 50X2-100 resin which had been previously washed with 1.2 M HCl. The solution was aged for 3 months to form a uniform reddish-brown colloidal gel (2.8 weight percent solids). The resulting vanadium oxide gels were either diluted with distilled water to 0.285 weight percent vanadium pentoxide (Sample I) or added to a solution of PVP in distilled water to give a solution containing 0.285 weight percent vanadium pentoxide and 0.14 weight percent PVP (Sample J).

Samples K and L

Colloidal vanadium oxide gels were prepared by hydrolysis of vanadium oxoalkoxide as taught in U.S. Pat. No.

5,407,603. 15.8 g of vanadium oxoisobutoxide was added to a stirred solution of 1.56 g of 30 percent hydrogen peroxide in 233 ml of water. The resulting dark brown gel was stirred at room temperature for 3 hours, poured into a glass jar and aged for 3 months at room temperature to yield a 2.2 weight percent reddish-brown gel. The resulting vanadium oxide gel was either diluted with distilled water to 0.285 weight percent vanadium pentoxide (Sample K) or added to a solution of PVP in distilled water to give a solution containing 0.285 weight percent vanadium pentoxide and 0.14 weight percent PVP (Sample L).

Samples M and N

Calcium-doped colloidal vanadium oxide gels were prepared by a melt-quench method similar to Samples E and F. A mixture of calcium oxide (up to 3 mole percent) and vanadium pentoxide was melted in a furnace, quenched into distilled water and aged for 3 months to form a uniform reddish-brown colloidal gel. The resulting vanadium oxide gel was either diluted with distilled water to 0.285 weight percent vanadium pentoxide (Sample M) or added to a solution of PVP in distilled water to give a solution containing 0.285 weight percent vanadium pentoxide and 0.14 weight percent PVP (Sample N).

Samples O and P

Doped colloidal vanadium oxide gels were prepared by a melt-quench method similar to Samples E and F. A mixture of silver oxide (up to 8 mole percent), lithium fluoride (up to 1 mole percent) and vanadium pentoxide was melted in a furnace, quenched into distilled water and aged for 3 months to form a uniform reddish-brown colloidal gel. The resulting vanadium oxide gel was either diluted with distilled water to 0.285 weight percent vanadium pentoxide (Sample O) or added to a solution of PVP in distilled water to a give a solution containing 0.285 weight percent vanadium pentoxide and 0.14 weight percent PVP (Sample P).

Samples Q and R

Zinc-doped colloidal vanadium oxide gels were prepared by a melt-quench technique similar to Samples E and F. A mixture of zinc oxide (up to 3 mole percent) and vanadium pentoxide was melted in a furnace, quenched into distilled water and aged for 3 months to form a uniform reddish-brown colloidal gel. The resulting vanadium oxide gel was either diluted with distilled water to 0.285 weight percent vanadium pentoxide (Sample Q) or added to a solution of PVP in distilled water to give a solution containing 0.285 weight percent vanadium pentoxide and 0.14 weight percent PVP (Sample R).

Samples S and T

Doped colloidal vanadium oxide gels were prepared by a melt-quench method similar to Samples E and F. A mixture of silicon dioxide (up to 4 mole percent), silver oxide (up to 8 mole percent) and vanadium pentoxide was melted in a furnace, quenched into distilled water and aged for 3 months to form a uniform reddish-brown colloidal gel. The resulting vanadium oxide gel was either diluted with distilled water to 0.285 weight percent vanadium pentoxide (Sample S) or added to a solution of PVP in distilled water to give a solution containing 0.285 weight percent vanadium pentoxide and 0.14 weight percent PVP (Sample T).

TABLE 1

DESCRIPTION OF VANADIUM OXIDE GELS.

| Sample | Type | wt % $V_2O_5$ | wt % PVP | Dopant species | Synthetic Method |
|---|---|---|---|---|---|
| Sample A | Comp. | 0.285 | — | undoped | melt-quench |
| Sample B | Inv. | 0.285 | 0.14 | undoped | melt-quench |
| Sample C | Inv. | 0.285 | 0.28 | undoped | melt-quench |
| Sample D | Inv. | 0.285 | 0.70 | undoped | melt-quench |
| Sample E | Comp. | 0.285 | — | Ag | melt-quench |
| Sample F | Inv. | 0.285 | 0.14 | Ag | melt-quench |
| Sample G | Inv. | 0.285 | 0.28 | Ag | melt-quench |
| Sample H | Inv. | 0.285 | 0.70 | Ag | melt-quench |
| Sample I | Comp. | 0.285 | — | undoped | ion exchange |
| Sample J | Inv. | 0.285 | 0.14 | undoped | ion exchange |
| Sample K | Comp. | 0.285 | — | undoped | oxoalkoxide |
| Sample L | Inv. | 0.285 | 0.14 | undoped | oxoalkoxide |
| Sample M | Comp. | 0.285 | — | Ca | melt-quench |
| Sample N | Inv. | 0.285 | 0.14 | Ca | melt-quench |
| Sample O | Comp. | 0.285 | — | AgO/LiF | melt-quench |
| Sample P | Inv. | 0.285 | 0.14 | AgO/LiF | melt-quench |
| Sample Q | Comp. | 0.285 | — | Zn | melt-quench |
| Sample R | Inv. | 0.285 | 0.14 | Zn | melt-quench |
| Sample S | Comp. | 0.285 | — | Si/Ag | melt-quench |
| Sample T | Inv. | 0.285 | 0.14 | Si/Ag | melt-quench |

EXAMPLES 1–8

Colloidal vanadium oxide gel samples A–H (0.285 weight percent) were spin-coated at 2000 rpm on glass microscope slides and allowed to air dry. The d-spacing (001) corresponding to the basal distance between vanadium layers in the coating was determined by X-ray diffraction using Cu $K_\alpha$ radiation. Table 2 gives d-spacing values for Examples 1–8. The increase in d-spacing of the undoped or doped vanadium oxide gel with increasing polyvinylpyrrolidone amount indicates intercalation of the polymer resulting in a modified vanadium oxide gel structure. Though by no means a requirement of the invention, it is believed that preferential association of vinyl-containing polymers with catalytically active or reactive sites consequently reduces chemical reactivity or hinders other compounds from reacting with the vanadium oxide, thereby resulting in the improved solution stability and thermal stability described below.

TABLE 2

XRD Results

| Sample | Vanadium oxide gel sample | wt % PVP | d-spacing (Å) |
|---|---|---|---|
| Example 1 | Sample A | 0 | 12.8 |
| Example 2 | Sample B | 0.14 | 20.7 |
| Example 3 | Sample C | 0.28 | 26.0 |
| Example 4 | Sample D | 0.70 | 40.6 |
| Example 5 | Sample E | 0 | 12.4 |
| Example 6 | Sample F | 0.14 | 23.6 |
| Example 7 | Sample G | 0.28 | 29.0 |
| Example 8 | Sample H | 0.70 | 38.0 |

EXAMPLE 9 and COMPARATIVE EXAMPLE 9

Vanadium pentoxide gel samples G and E were mixed with a para-(t-octyl)phenoxy poly(ethoxy) ethanol surfactant commercially available from Rohm & Haas under the tradename Triton X-100 at a nominal ratio of 1/1 for Example 9 and Comparative Example 9, respectively. Nominally 3.6 mg of the sample containing vanadium pentoxide and surfactant was placed in a 20 ml septum capped headspace vial. The samples were equilibrated at 100° C. for two hours. The headspace above the sample was analyzed by Headspace GC mass spectrometry using a Perkin-Elmer HS-40 Headspace analyzer. Separation was achieved with a 30M, Restek Rtx-50, 0.25 mm ID, 1Vm thick film capillary column. The gas chromatograph oven was preheld at 40° C. for four minutes and then heated to 250° C. at 15° C./min. The mass scan range was from 21 to 250 atomic mass units with a 3 minute solvent delay. In addition, vanadium pentoxide gel samples E and G without a surfactant were evaluated. Reaction products and retention times for the samples are given in Table 3.

EXAMPLE 10 and COMPARATIVE EXAMPLE 10

Vanadium pentoxide gel samples G and E were mixed with a paraisononylphenoxy polyglycidol surfactant commercially available from Olin Mathieson Corporation under the tradename Surfactant 10 G at a nominal ratio of 1/1 for Example 10 and Comparative Example 10, respectively. Nominally 3.6 mg of the sample containing vanadium pentoxide and surfactant was placed in a 20 ml septum capped headspace vial. The samples were equilibrated at 100° C. for two hours. The headspace above the sample was analyzed by Headspace GC mass spectrometry using a Perkin-Elmer HS-40 Headspace analyzer. Separation was achieved with a 30M, Restek Rtx-50, 0.25 mm ID, 1 $\mu$m thick film capillary column. The gas chromatograph oven was preheld at 40° C. for four minutes and then heated to 250° C. at 15° C./min. The mass scan range was from 21 to 250 atomic mass units with a 3 minute solvent delay. In addition, vanadium pentoxide gel samples E and G without a surfactant were evaluated. Reaction products and retention times for the samples are given in Table 3.

TABLE 3

GC Mass spectrometry results with surfactants (units are in mass spectrometer detector area counts)

| species | Sample E | Sample G | Ex. 9 | Comp. Ex. 9 | Ex. 10 | Comp. Ex. 10 |
|---|---|---|---|---|---|---|
| Formic acid | 0 | 0 | 13.5 | 309.7 | 5.9 | 14.2 |
| 1,2-Ethanediol Monoformate | 0 | 0 | 0 | 12.4 | 0 | 0 |
| 1,2-Ethanediol diformate | 0 | 0 | 0 | 123.1 | 0 | 0 |
| 2-Methoxy-1,3-Dioxane | 0 | 0 | 0 | 115.1 | 0 | 8.5 |

EXAMPLE 11 and COMPARATIVE EXAMPLE 11

Vanadium oxide gel samples E and F were spin coated on silicon wafers. One microliter of acetone was added to the vanadium oxide coatings from samples E and F for Comparative Example 11 and Example 11, respectively. The coated silicon wafers were placed in 22 ml headspace vials and equilibrated for 3 hrs at 125° C. The headspace above the samples was analyzed using a Perkin-Elmer HS-40 Headspace analyzer. The gas chromatagraph oven was held for 3 minutes at 40° C., then heated to 230° C. at 12° C./min and held for 5 minutes at 230° C. The mass scan range was from 21 to 550 atomic mass units. Gas chromatography results for the samples and for acetone similarly applied to a silicon wafer without a vanadium oxide coating are given in Table 4.

TABLE 4

GC Mass spectrometry results with acetone. (units are in mass spectrometer detector area counts)

| species | retention time (min.) | acetone onto Si wafer | Comp. Ex. 11 | Example 11 |
|---|---|---|---|---|
| Acetone | 4.8 | 1239 | 1209 | 1281 |
| Acetic Acid | 14.5 | 0 | 58.3 | 12.8 |
| Formic Acid | 15.3 | 0 | 36.4 | 4.4 |

EXAMPLE 12 and COMPARATIVE EXAMPLE 12

Nominally equal amounts of vanadium pentoxide gel Samples E and G were placed in 22 ml headspace vials and one microliter of acetone was injected into the vials containing Samples E and G for Comparative Example 12 and Example 12, respectively. The samples were equilibrated at 100° C. for two hours. The headspace above the sample was analyzed by Headspace GC mass spectrometry using a Perkin-Elmer HS-40 Headspace analyzer. Separation was achieved with a 30M, Restek Rtx-50, 0.25 mm ID, Ium thick film capillary column. The gas chromatograph oven was preheld at 40° C. for four minutes and then heated to 230° C. at 12° C./min and held at 230° C. for 5 minutes. The mass scan range was from 21 to 550 atomic mass units. GC analysis was also obtained for Samples E and G without the addition of acetone and for acetone without the presence of vanadium oxide gel. Reaction products and retention times for the samples are given in Table 5.

TABLE 5

GC Mass spectrometry results with acetone. (units are in mass spectrometer detector area counts)

| species | retention time (min) | Sample E | Sample G | Acetone | Comp. Ex. 12 | Ex. 12 |
|---|---|---|---|---|---|---|
| Acetone | 4.6 | 0 | 0 | 3333 | 3121.7 | 3325.8 |
| Acetic acid | 14.5 | 0 | 0 | 0 | 182.0 | 8.6 |
| Formic acid | 15.27 | 0 | 0 | 0 | 114.2 | 0 |

EXAMPLE 13 and COMPARATIVE EXAMPLE 13

Nominally equal amounts of vanadium pentoxide gel Samples E and G were placed in 22 ml headspace vials and one microliter of methanol was then injected into the vials containing Samples E and G for Comparative Example 13 and Example 13, respectively. The samples were equilibrated at 100° C. for two hours. The headspace above the sample was analyzed by Headspace GC mass spectrometry using a Perkin-Elmer HS-40 Headspace analyzer. Separation was achieved with a 30M, Restek Rtx-50, 0.25 mm ID, 1 $\mu$m thick film capillary column. The gas chromatograph oven was preheld at 40° C. for four minutes and then heated to 230° C. at 12° C./min and held at 230° C. for 5 minutes. The mass scan range was from 21 to 550 atomic mass units. GC analysis was also obtained for Samples E and G without the addition of methanol and for methanol without the presence of vanadium oxide gel. Reaction products and retention times for the samples are given in Table 6.

TABLE 6

GC Mass spectrometry results with methanol.
(units are in mass spectrometer detector area counts)

| species | retention time (min) | Sample E E | Sample G G | Methanol | Comp. Ex. 13 | Ex. 13 |
|---|---|---|---|---|---|---|
| Dimethoxy methane | 3.5 | 0 | 0 | 0 | 218.1 | 118.2 |
| Methyl formate | 3.8 | 0 | 0 | 0 | 588.4 | 50.6 |
| Methanol | 5.9 | 0 | 0 | 2425 | 874.1 | 2414.2 |
| Acetic acid | 14.5 | 0 | 0 | 0 | 0 | 93.0 |
| Formic Acid | 15.27 | 0 | 0 | 0 | 48.4 | 0 |

EXAMPLE 14 and COMPARATIVE EXAMPLE 14

Nominally equal amounts of vanadium pentoxide gel Samples E and G were placed in 22 ml headspace vials and one microliter of n-butanol was injected into the vials containing Samples E and G for Comparative Example 14 and Example 14, respectively. The samples were equilibrated at 100° C. for two hours. The headspace above the sample was analyzed by Headspace GC mass spectrometry using a Perkin-Elmer HS-40 Headspace analyzer. Separation was achieved with a 30M, Restek Rtx-50, 0.25 mm ID, 1 μm thick film capillary column. The gas chromatograph oven was preheld at 40° C. for four minutes and then heated to 230° C. at 12° C./min and held at 230° C. for 5 minutes. The mass scan range was from 21 to 550 atomic mass units. GC analysis was also obtained for Samples E and G without the addition of n-butanol and for n-butanol without the presence of vanadium oxide gel. Reaction products and retention times for the samples are given in Table 7.

TABLE 7

GC Mass spectrometry results with butanol.
(units are in mass spectrometer detector area counts)

| species | retention time | Sample E | Sample G | n-butanol | Comp. Ex. 14 | Ex. 14 |
|---|---|---|---|---|---|---|
| Acetaldehyde | 3.23 | 0 | 0 | 0 | 43.5 | 0 |
| Propanal | 4.26 | 0 | 0 | 0 | 298.6 | 62.45 |
| Butanal | 5.63 | 0 | 0 | 0 | 2900.65 | 1416.35 |
| Butyl Formate | 8.23 | 0 | 0 | 0 | 1157.4 | 129.85 |
| Butanal | 8.73 | 0 | 0 | 0 | 63.35 | 15.65 |
| Butyl Acetate | 9.11 | 0 | 0 | 0 | 135.15 | 14.5 |
| Butanol | 10.21 | 0 | 0 | 4485 | 2604.55 | 3914.4 |
| Acetic Acid | 14.5 | 0 | 0 | 0 | 67.8 | 11.53 |
| Formic Acid | 15.29 | 0 | 0 | 0 | 102.3 | 9.85 |
| Propanoic Acid | 15.5 | 0 | 0 | 0 | 128.6 | 15.85 |
| Butanoic Acid | 16.5 | 0 | 0 | 0 | 77.4 | 6 |

The above results for Examples 9–14 clearly indicate intercalated vanadium oxide gels have greatly reduced reactivity with common coating solvents or surfactants than prior art colloidal vanadium oxide (Comparative Examples 9–14). In particular, there are fewer species detected after reaction with intercalated vanadium oxide gels than after reaction with non-intercalated vanadium oxide. Furthermore, for the identified species from reaction with intercalated vanadium oxide, there is typically a reduced level present when compared with non-intercalated vanadium oxide. The reduced catalytic or chemical activity resulting for intercalated vanadium oxide is of particular interest for photographic imaging elements which may be fogged by the evolution of unanticipated chemical species from a coated layer and for applications in which reaction with common solvents can result in a corrosive environment due to the formation of various organic acids.

EXAMPLE 15

Vanadium oxide gel sample F intercalated with polyvinylpyrrolidone was placed in a prewetted Spectra/Por molecular porous membrane dialysis tube having a molecular weight cutoff of 12,000–14,000 and a dry thickness of 0.9 mil (23 microns). The tube ends were tied and the filled dialysis tube placed in a 4000 ml beaker of continuously replenished distilled water and allowed to dialyze for one week. The resulting vanadium oxide gel sample had a uniform dark reddish-brown coloration with no observable change in appearance.

A coating solution consisting of 0.0285 weight percent dialyzed vanadium pentoxide gel, 0.0285 weight percent terpolymer latex binder and 0.02 weight percent Triton X-100 (Rohm & Haas) was coated on a 4 mil (100 μm) thick polyethylene terephthalate support using a coating rod to give a 3 mil (76 μm) wet coverage and a nominal dry coverage of 0.022 g/m$^2$. The terpolymer latex consisted of acrylonitrile, vinylidene chloride, and acrylic acid. The support had been coated previously with a typical primer layer consisting of acrylonitrile, vinylidene chloride, and acrylic acid. The surface electrical resistivity (SER) of the conductive layer was measured at nominally 20° C. and 50% relative humidity using a two-point DC electrode method similar to that described in U.S. Pat. No. 2,801,191. For adequate antistatic performance, conductive layers with SER values of 10 log ohms/square or less are preferred. The SER value for the vanadium oxide gel coating was 8.3 log ohms/sq. indicating excellent antistatic properties for the dialyzed vanadium oxide gel.

COMPARATIVE EXAMPLE 15

Vanadium oxide gel sample E was placed in a prewetted Spectra/Por molecular porous membrane dialysis tube having a molecular weight cutoff of 12,000–14,000 and a dry thickness of 0.9 mil (23 microns). The tube ends were tied and the filled dialysis tube placed in a 4000 ml beaker of continuously replenished distilled water and dialyzed for one week. The resulting vanadium oxide gel sample had a light orange brown appearance with green-brown fibular debris rather than a uniform dark reddish-brown coloration indicating considerable degradation of the gel structure.

A coating solution consisting of 0.0285 weight percent dialyzed vanadium oxide gel, 0.0285 weight percent terpolymer latex binder and 0.020 weight percent Triton X-100 was coated on 4 mil (100 $\mu$m) thick polyethylene terephthalate support using a coating rod to give a 3 mil (76 $\mu$m) wet coverage and a nominal dry coverage of 0.022 g/m$^2$. The terpolymer latex consisted of acrylonitrile, vinylidene chloride, and acrylic acid. The support had been coated previously with a typical primer layer consisting of acrylonitrile, vinylidene chloride, and acrylic acid. The SER value for the vanadium oxide gel coating was greater than 12 log ohms/sq. which is not considered effective for antistatic applications.

EXAMPLES 16–23 and COMPARATIVE EXAMPLES 16–23

Solutions of vanadium oxide gel samples A–T were diluted with distilled water to 0.0285 weight percent vanadium pentoxide. The solutions had 0.020 weight percent of Triton X-100 added as a coating aid. The solutions were coated on 4 mil (100 $\mu$m) thick polyethylene terephthalate supports using a coating rod to give a 3 mil (76 $\mu$m) wet coverage and a nominal dry coverage of 0.022 g/m . The support had been coated previously with a typical primer layer consisting of a terpolymer latex of acrylonitrile, vinylidene chloride, and acrylic acid. Coatings were prepared using fresh solutions or aged solutions. The coatings were dried at 100° C. for 1 minute. SER values for vanadium oxide gel layers are given in Table 8.

EXAMPLES 24–31 and COMPARATIVE EXAMPLES 24–31

Solutions of vanadium oxide gel samples A–T were diluted with ethanol to 0.0285 weight percent vanadium pentoxide. The solutions had 0.020 weight percent of Triton X-100 added as a coating aid. The solutions were coated on 4 mil (100 $\mu$m) thick polyethylene terephthalate supports using a coating rod to give a 3 mil (76 $\mu$m) wet coverage and a nominal dry coverage of 0.022 g/m$^2$. The support had been coated previously with a typical primer layer consisting of a terpolymer latex of acrylonitrile, vinylidene chloride, and acrylic acid. Coatings were prepared using fresh solutions or aged solutions. The coatings were dried at 100° C. for 1 minute. SER values for vanadium oxide gel layers are given in Table 9.

EXAMPLES 32–39 and COMPARATIVE EXAMPLES 32–39

Solutions of vanadium oxide gel samples A–T were diluted with a 50:50 mixture of ethanol and acetone to 0.0285 weight percent vanadium pentoxide. The solutions had 0.020 weight percent of Triton X-100 added as a coating aid. The solutions were coated on 4 mil (100 $\mu$m) thick polyethylene terephthalate supports using a coating rod to give a 3 mil (76 $\mu$m) wet coverage and a nominal dry coverage of 0.022 g/m$^2$. The support had been coated previously with a typical primer layer consisting of a terpolymer latex of acrylonitrile, vinylidene chloride, and acrylic acid. Coatings were prepared using fresh solutions or aged solutions. The coatings were dried at 100° C. for 1 minute. SER values for vanadium oxide gel layers are given in Table 10.

TABLE 8

Surface electfical resistivity (log ohms/sq) of vanadium oxide gel coatings from aqueous solutions

| | | SER log ohms/sq. | | | |
|---|---|---|---|---|---|
| Sample | $V_2O_5$ oxide gel sample | Fresh soln | aged soln (2 weeks) | aged soln (10 weeks) | aged soln (6 months) |
| Example 16 | Sample B | 9.3 | 9.2 | 9.4 | ** |
| Example 17 | Sample F | 7.7 | 7.7 | ** | 8.5 |
| Example 18 | Sample J | 8.5 | 8.7 | 9.0 | ** |
| Example 19 | Sample L | 8.5 | 8.2 | 9.0 | ** |
| Example 20 | Sample N | 8.3 | 8.6 | 9.1 | ** |
| Example 21 | Sample P | 7.6 | 7.9 | 8.5 | ** |
| Example 22 | Sample R | 7.7 | 7.9 | 8.5 | ** |
| Example 23 | Sample T | 9.3 | 9.5 | 9.7 | ** |
| Comp. Ex 16 | Sample A | 9.1 | 9.3 | 11.9 | ** |
| Comp. Ex 17 | Sample E | 7.4 | 8.0 | ** | >12 |
| Comp. Ex 18 | Sample I | 8.6 | 9.0 | >12 | ** |
| Comp. Ex 19 | Sample K | 8.4 | 8.9 | >12 | ** |
| Comp. Ex 20 | Sample M | 8.1 | 8.5 | >12 | ** |
| Comp. Ex 21 | Sample O | 7.7 | 7.8 | >12 | ** |
| Comp. Ex 22 | Sample Q | 7.9 | 7.8 | >12 | ** |
| Comp. Ex 23 | Sample S | 9.4 | 9.9 | >12 | ** |

TABLE 9

Surface electrical resistivity (log ohms/sq) of vanadium oxide gel coatings from ethanolic solutions.

| | | SER log ohms/sq for coatings | | | |
|---|---|---|---|---|---|
| Sample | $V_2O_5$ oxide gel sample | Fresh soln | aged soln (2 weeks) | aged soln (10 weeks) | aged soln (6 months) |
| Example 24 | Sample B | 9.1 | 9.3 | 9.5 | ** |
| Example 25 | Sample F | 7.6 | 7.9 | ** | 8.1 |
| Example 26 | Sample J | 8.4 | 8.8 | 9.1 | ** |
| Example 27 | Sample L | 8.3 | 8.9 | 9.1 | ** |
| Example 28 | Sample N | 8.2 | 8.5 | 9.0 | ** |
| Example 29 | Sample P | 7.9 | 8.5 | 8.8 | ** |
| Example 30 | Sample R | 8.0 | 8.4 | 8.6 | ** |
| Example 31 | Sample T | 9.1 | 9.0 | 9.6 | ** |
| Comp. Ex 24 | Sample A | 9.3 | 9.2 | >12 | ** |
| Comp. Ex 25 | Sample E | 6.7 | 9.2 | ** | >12 |
| Comp. Ex 26 | Sample I | 8.7 | 9.3 | >12 | ** |
| Comp. Ex 27 | Sample K | 8.5 | 9.2 | >12 | ** |
| Comp. Ex 28 | Sample M | 8.0 | 8.7 | >12 | ** |
| Comp. Ex 29 | Sample O | 8.0 | 7.9 | >12 | ** |
| Comp. Ex 30 | Sample Q | 8.2 | 8.1 | >12 | ** |
| Comp. Ex 31 | Sample S | 9.6 | 9.8 | >12 | ** |

TABLE 10

Surface electrical resistivity (log ohms/sq) of vanadium oxide gel coatings prepared from acetone/ethanol mixtures.

| | | SER log ohms/sq. for coatings | | | |
|---|---|---|---|---|---|
| Sample | $V_2O_5$ oxide gel sample | Fresh soln | aged soln (2 weeks) | aged soln (10 weeks) | aged soln (6 months) |
| Example 32 | Sample B | 9.1 | 9.4 | 9.3 | ** |
| Example 33 | Sample F | 8.3 | 8.3 | ** | 8.4 |

TABLE 10-continued

Surface electrical resistivity (log ohms/sq) of vanadium oxide gel coatings prepared from acetone/ethanol mixtures.

| Sample | $V_2O_5$ oxide gel sample | SER log ohms/sq. for coatings | | | |
|---|---|---|---|---|---|
| | | Fresh soln | aged soln (2 weeks) | aged soln (10 weeks) | aged soln (6 months) |
| Example 34 | Sample J | 8.3 | 8.7 | 9.0 | ** |
| Example 35 | Sample L | 8.4 | 8.5 | 9.0 | ** |
| Example 36 | Sample N | 8.1 | 8.7 | 9.1 | ** |
| Example 37 | Sample P | 8.1 | 7.9 | 9.0 | ** |
| Example 38 | Sample R | 8.1 | 8.0 | 8.7 | ** |
| Example 39 | Sample T | 9.2 | 9.5 | 9.8 | ** |
| Comp. Ex 32 | Sample A | 9.0 | 9.4 | >12 | ** |
| Comp. Ex 33 | Sample E | 7.8 | 8.2 | ** | >12 |
| Comp. Ex 34 | Sample I | 8.7 | 9.4 | >12 | ** |
| Comp. Ex 35 | Sample K | 8.6 | 9.1 | >12 | ** |
| Comp. Ex 36 | Sample M | 8.2 | 8.5 | >12 | ** |
| Comp. Ex 37 | Sample O | 7.6 | 7.8 | >12 | ** |
| Comp. Ex 38 | Sample Q | 7.8 | 8.0 | >12 | ** |
| Comp. Ex 39 | Sample S | 9.5 | 9.6 | >12 | ** |

The above examples demonstrate the improved solution stability and thermal stability for either aqueous dispersions or solvent-based dispersions of vanadium oxide gels intercalated with a water soluble vinyl-containing polymer relative to prior art vanadium oxide gels. The improved solution stability with a variety of solvents and polymeric species allows improved flexibility in formulation of conductive layers containing vanadium oxide. Improved thermal stability avoids adverse reactions which may result due to reaction of vanadium oxide and components of the conductive layer, adjacent layers or solutions that the conductive layer comes in contact with during use of the element or articles. Consequently, intercalated vanadium oxide provides conductive layers which more adequately satisfy the diverse needs of antistatic protection than prior art vanadium oxide. Furthermore, improved solution stability is desirable for manufacturing simplicity and can reduce coating defects due to agglomeration or coagulation of the coating formulation or as a result of filter plugging.

The invention has been described in detail with particular reference to certain preferred embodiments thereof, but it will be understood that variations and modifications can be effected within the spirit and scope of the invention.

What is claimed is:

1. A process for forming an electrically conductive layer comprising (i) intercalating colloidal vanadium oxide with a water soluble vinyl-containing polymer, (ii) incorporating the intercalated colloidal vanadium oxide in a coating composition, and (iii) coating the coating composition on a substrate; wherein the coating composition comprises a film-forming binder which is distinct from the water soluble vinyl-containing polymer.

2. The process of claim 1, wherein the weight ratio of colloidal vanadium oxide to film-forming binder is from 4:1 to 1:500.

3. The process of claim 2, wherein the weight ratio of colloidal vanadium oxide to film-forming binder is from 2:1 to 1:250.

4. The process of claim 1, wherein the water soluble vinyl-containing polymer is selected from the group consisting of poly-N-vinylpyrrolidone, polyvinylpyrrolidone interpolymers, polyvinylpyrrolidone-polyvinylacetate, polyvinyl alcohol, polyvinyl alcohol interpolymers, polyvinyl alcohol-ethylene, and polyvinyl methyl ether.

5. The process of claim 4, wherein the water soluble vinyl-containing polymer is selected from the group consisting of poly-N-vinylpyrrolidone and polyvinylpyrrolidone interpolymers.

6. The process of claim 1, wherein the water soluble vinyl-containing polymer has a molecular weight of from 10,000 to 400,000.

7. The process of claim 1, wherein the molar ratio of the water soluble vinyl-containing polymer to colloidal vanadium oxide is from 1:4 to 20:1.

8. The process of claim 1, wherein the molar ratio of the water soluble vinyl-containing polymer to colloidal vanadium oxide is from 1:2 to 5:1.

9. The process of claim 1, wherein in the colloidal vanadium oxide is intercalated with the water soluble vinyl-containing polymer by adding a vanadium oxide gel solution to an aqueous solution of the polymer at a weight concentration of vanadium oxide of at least 0.15 weight percent in the combined solution, and the weight concentration of vanadium oxide in the coating composition is diluted to less than 0.15 weight percent.

10. The process of claim 9, wherein the weight concentration of vanadium oxide in the coating composition is diluted to less than 0.1 weight percent.

11. The process of claim 10, wherein the weight concentration of vanadium oxide in the coating composition is diluted to less than 0.05 weight percent.

12. The process of claim 1, wherein the colloidal vanadium oxide contains from 0.1 to 20 mole percent of a compound selected from the group containing Ca, Mg, Mo, W, Zn, and Ag.

13. The process of claim 1, wherein the colloidal vanadium oxide contains from 0.1 to 20 mole percent silver.

14. A composition for forming an electrically conductive element or layer thereof comprising (i) colloidal vanadium oxide intercalated with a water soluble vinyl-containing polymer and (ii) a binder which is distinct from the water soluble vinyl-containing polymer.

15. A composition according to claim 14, wherein the intercalated colloidal vanadium oxide and binder are dispersed in a coating solution and the binder comprises a film-forming binder.

16. A composition according to claim 15, wherein the weight ratio of colloidal vanadium oxide to film-forming binder is from 4:1 to 1:500.

17. A composition according to claim 15, wherein the water soluble vinyl-containing polymer is selected from the group consisting of poly-N-vinylpyrvolidone, polyvinylpyrrolidone interpolymers, polyvinylpyrrolidone-polyvinylacetate, polyvinyl alcohol, polyvinyl alcohol interpolymers, polyvinyl alcohol-ethylene, and polyvinyl methyl ether.

18. A composition according to claim 17, wherein the water soluble vinyl-containing polymer is selected from the group consisting of poly-N-vinylpyrrolidone and polyvinylpyrrolidone interpolymers.

19. A composition according to claim 15, wherein the film-forming binder comprises water-soluble polymers, gelatin, cellulose derivatives, water-insoluble polymers, water-dispersible polyesterionomers, vinylidene chloride-based terpolymers, vinyl acetate-based interpolymers, vinyl acetate-ethylene emulsions, or water-dispersible polyurethanes.

20. A composition for forming an electrically conductive element or layer thereof comprising (i) colloidal vanadium oxide intercalated with a water soluble vinyl-containing polymer and (ii) a binder which is distinct from the water soluble vinyl-containing polymer, wherein the intercalated colloidal vanadium oxide and binder are dispersed in a coating solution, the binder comprises a film-forming binder, and the weight concentration of vanadium oxide is less than 0.1 weight percent.

21. A composition according to claim 20, wherein the weight concentration of vanadium oxide is less than 0.05 weight percent.

22. A composition according to claim 14, wherein the colloidal vanadium oxide contains from 0.1 to 20 mole percent of a compound selected from the group containing Ca, Mg, Mo, W, Zn, and Ag.

23. A composition according to claim 22, wherein the colloidal vanadium oxide contains from 0.1 to 20 mole percent silver.

* * * * *